US006488463B1

(12) United States Patent
Harris

(10) Patent No.: US 6,488,463 B1
(45) Date of Patent: Dec. 3, 2002

(54) ELEVATOR ICE TRAY STORAGE APPARATUS

(76) Inventor: Grady E. Harris, 8913 Locust Ave., Tampa, FL (US) 33604

( * ) Notice: Subject to any disclaimer, the term of this patent is extended or adjusted under 35 U.S.C. 154(b) by 57 days.

(21) Appl. No.: 09/867,322

(22) Filed: May 29, 2001

(51) Int. Cl.[7] ..... B65G 1/00
(52) U.S. Cl. ..... 414/331.14; 414/795.2
(58) Field of Search ..... 414/331.14, 795.2

(56) References Cited

U.S. PATENT DOCUMENTS

| | | | | |
|---|---|---|---|---|
| 2,049,934 A | | 8/1936 | Witherspoon | |
| 3,352,528 A | | 11/1967 | Bernstrom | |
| 3,670,523 A | | 6/1972 | Fogt et al. | |
| 3,831,293 A | * | 8/1974 | Ingram et al. | 34/236 |
| 4,352,617 A | * | 10/1982 | Sakai | 414/95 |
| 4,588,341 A | * | 5/1986 | Motoda | 414/331.14 |
| 4,789,130 A | | 12/1988 | Stich et al. | |
| D307,280 S | | 4/1990 | Waller et al. | |
| 5,830,379 A | | 11/1998 | Tunzi | |

FOREIGN PATENT DOCUMENTS

| | | | | |
|---|---|---|---|---|
| JP | 59108618 | * | 6/1984 | 414/795.2 |

* cited by examiner

*Primary Examiner*—Steven A. Bratlie
(74) *Attorney, Agent, or Firm*—Dennis G. LaPointe; Mason Law, P.A.

(57) ABSTRACT

An elevator ice tray storage apparatus includes a storage bin and an elevator platform assembly overlying the bottom of the storage bin. The assembly includes a base member which slides on the bottom of the storage bin, and a platform for elevating an ice tray into a first elevated storage position. A handle and guides are provided for facilitating the manipulation of the elevator assembly. Rollers are provided at the back end of the platform for rolling against the back end wall of the storage bin as the elevator assembly elevates an ice tray. One or more elevated storage positions are provided, each having hinged flaps that rotate out of the way to allow a tray to pass by as it is being elevated and which rotate back to a flat repose position, on which side edges of a tray are lowered to rest.

22 Claims, 7 Drawing Sheets

ELEVATOR ICE TRAY STORAGE APPARATUS

BACKGROUND OF THE INVENTION

1. Field of the Invention

The invention relates to the storage of ice trays in a refrigerator freezer portion where the trays are stored in a stacked orientation inside a bin using an elevator platform to insert each consecutive tray.

2. Description of Related Art

Ice trays and methods of stacking are known in the art. However, most are designed such that the trays themselves are independently stackable or are stackable within a container bin.

All of these prior art devices still have disadvantages when a tray freshly filled with water is inserted in the freezer. For example, as a consumer attempts to reach in and place a tray on top of another, water often times is spilled over to the side. If a tray already placed on top of a tray with frozen ice cubes, has yet to freeze and a consumer desires ice cubes, the consumer must carefully raise the tray with water and carefully pull the lower tray out of the freezer. This inevitably leads to some spilling of water more often then not because of the coordination required when a consumer at eye level is reaching away from his body to handle trays with fingers.

When other objects in the freezer do not stack well such as frozen backs of french fries or chicken fillets, or certain meats such as hamburger packages, they often slide to side against stacked trays which again may spill water if not yet frozen. Frozen water on the bottom surface of a freezer not only affects the efficiency of the freezer portion but if the water works its way into the coil portion of the freezer, then the coils may freeze over making the freezer portion work extremely inefficient.

Known related art includes the ice tray and storage container depicted in U.S. Pat. No. 3,670,523 to Fogt et al., the pan and ice trays depicted in U.S. Pat. No. 3,352,528, the stackable ice tray and bin assembly depicted in U.S. Pat. No. 5,830,379 to Tunzi, the container and ice cube tray assembly depicted in U.S. Pat. No. 4,789,130 to Stich et al. and the rotatable ice cube tray unit depicted in U.S. Design Pat. No. Des. 307,280 to Waller et al.

The Waller unit assumes that the trays contain frozen ice and the trays themselves are designed so that when the bottom tray is pulled, as shown in FIG. 7, a careful view of FIG. 8 shows that the next tray above the pulled tray will drop down, most likely starting from the back end, until it fully drops to the bottom surface of the bin. If any trays still have unfrozen water in the cube portions, water is certain to spill inside the bin.

None of the devices in the above references solve the problem of ensuring that any tray containing water is inserted while supported to prevent spillage, and is stacked in relation to other trays in such a way that the other trays are not tipped or fall over.

SUMMARY OF THE INVENTION

The present invention is an elevator ice tray storage apparatus which includes an ice tray storage bin having a bottom, opposite spaced-apart side walls, a back end wall and an open front end; and means for elevating ice trays to a first elevated storage position, said first elevated storage position having means for level supporting of ice tray side edges along the side walls of the storage bin, wherein when said means for elevating ice trays is lowered to its lowest position, a height between said means for elevating ice trays and a lower surface of a first ice tray being supported at the first elevated storage position is sufficient to enable a second ice tray to be placed on said means for elevating ice trays.

The means for elevating ice trays includes an elevator platform assembly in an overlying relationship to the bottom of the storage bin. The elevator platform assembly includes a base member which is in a slidable relationship with the underlying bottom of the storage bin, and a platform parallel to and above the base member, the platform constituting a platform for supporting and elevating an ice tray to be stored in the storage bin at the first elevated storage position.

A first riser member is pivotally connected to an upper surface of the base member near a back end of said base member. This first riser member is also pivotally connected to a lower surface of the platform at a predetermined distance from a back end of said platform. A second riser member is pivotally connected to the upper surface of the base member at a predetermined distance from a front end of said base member. As with the first riser member, this second riser member is also pivotally connected to the lower surface of the platform at a predetermined distance from a front end of said platform. The first and second riser members are the same height and pivotally connected so as to maintain a parallel relationship as the elevator platform assembly is manipulated.

The back end of said platform further has roller means which engage the back end wall of the storage bin and roll up and down the back end wall of the storage bin as the elevator platform assembly is manipulated to store ice trays in the storage bin. The back end of the platform and the back end of the base member are offset from each other such that the back end of the base member is spaced from the back end wall of the storage bin a distance greater than a distance of the back end of the platform from the back end wall of the storage bin.

In other embodiments of the invention where more than two trays are intended to be stored, that is, one at the first elevated storage position and one on the platform, the invention includes a second elevated storage position above the first elevated storage position or a second and third elevated storage position, the third elevated storage position being above the second elevated storage position. The second elevated storage position has means for level supporting of ice tray side edges along the side walls of the storage bin and the third elevated storage position also has means for level supporting of ice tray side edges along the side walls of the storage bin.

In operation, when a second ice tray is elevated for placement at the first elevated storage position, the second ice tray comes into contact with the first ice tray. The means for elevating ice trays then elevates both the first and second ice trays until the first ice tray is positionable at the second elevated storage position. The means for elevating ice trays is then lowered so that the first ice tray comes to rest on the means for level supporting of ice tray side edges at the second elevated storage position. When the third elevated storage position is incorporated into the apparatus, the third ice tray is elevated for placement at the first elevated storage position, the third ice tray comes into contact with the second ice tray, and the second ice tray then comes into contact with the first ice tray as the means for elevating ice trays continues to elevate, the means for elevating ice trays then elevates the first, second and third ice trays until the first ice tray is positionable at the third elevated storage position, the means for elevating ice trays is then lowered so that the first ice tray comes to rest on the means for level supporting of ice tray side edges at the third elevated storage position, the means for elevating ice trays then continues to be lowered until the second ice tray comes to rest on the means for level supporting of ice tray side edges at the second elevated storage position, the means for elevating ice trays then continues to be lowered so that the third ice tray comes to rest on the means for level supporting of ice tray side edges at the first elevated storage position.

It is preferred that the bottom of the storage bin includes means for guiding the travel of the base member in and out of the storage bin from the front end of the storage bin.

The means for level supporting of ice tray side edges along the side walls of the storage bin at the first, second or third elevated storage positions preferably includes at least one longitudinally hinged ice tray support on each side wall, each being parallel to and of substantially equal distance from the bottom of the storage bin, with each at least one longitudinally hinged ice tray support constituting a flap which is rotatable from a generally horizontal planar position of repose to a generally vertical position when side edges of the ice tray to be stored engage corresponding opposite flaps while being elevated to the first elevated storage position, and the corresponding opposite flaps returning to the repose position after each tray is elevated past a rotated height of the flaps. When the ice tray to be stored is then lowered, its corresponding side edges engage and rest on the corresponding opposite flaps.

When the ice tray is placed on the platform for elevated storage, the base member is pushed toward the back end of the bin, simultaneously allowing the roller means at the back end of the platform to vertically roll against the end wall of the storage bin and in turn rotating the riser members toward a vertical orientation until the platform elevates the ice tray a sufficient height so its side edges engage and upwardly push the first row of the corresponding opposite flaps, passing said corresponding opposite flaps at the first elevated storage position to allow them to return to the position of repose, and when the base member is then pulled back to lower the platform, the ice tray lowers and its side edges engage the corresponding flaps in the position of repose, allowing the platform to be lowered a sufficient spacing from a bottom of the ice tray stored in the first elevated storage position to further allow the subsequent placement of the second ice tray on the platform.

The means for guiding the travel of the base member preferably includes means for minimizing one of lateral movement, vertical movement and a combination of lateral and vertical movement of the base member as it slides in and out of the storage bin. In addition, the base member should include means for facilitating the sliding of the base member in and out of the front end of the storage bin while inserting an ice tray, such as handle means on a portion of the base member adjacent the front end of the storage bin.

In order to maintain some rigidity or at least to prevent the upper portion of the storage bin from spreading open which could make an ice tray dislodge from the supporting flaps, it is recommended that means at the top of the storage bin for maintaining the side walls in a generally parallel relationship be provided. This can simply be some bracing or strapping like members across designated portions at the top of the storage bin, in particular, at least across the front edge or near the front edge of the storage bin.

The storage bin bottom, side walls and back end wall may be continuously formed such as in an injection molding process therein making the joints integral, or they may be fixedly connected such as by adhesive or other mechanical means like fasteners, or a combination of such means may be incorporated.

It is not necessary that the platform be allowed to be lowered such that the platform, riser members and base member essentially lay on top of the other; however, it is recommended that a first support member vertically extending from the bottom of the storage bin near the back end of the storage bin for support engagement of the platform in its lowered position be provided, and a second support member vertically extending from an intermediate location on the base member of the elevator platform assembly for support engagement of the platform in its lowered position be provided. The first and second support members are dimensioned so as to maintain the platform in a generally parallel relationship to the bottom of the storage bin, yet spaced apart a desired predetermined distance.

If the riser members rotate 90° or greater, it is possible that when the base member is pulled to start lowering the trays, that all the trays will instead come out of the storage bin at once and the platform will not lower unless the riser members are caused to be nudged to less than a 90° orientation. If this is undesirable, then it is recommended that means for limiting the inward travel of the base member be provided so that the first and second riser members are prevented from elevating into this generally vertical orientation.

Although it may be preferred that the elevator platform assembly be readily removable from the storage bin to provide ready access for cleaning the storage bin, means for limiting the outward travel of the base member to prevent the elevator platform assembly from completely exiting the storage bin, may optionally be provided.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 1:
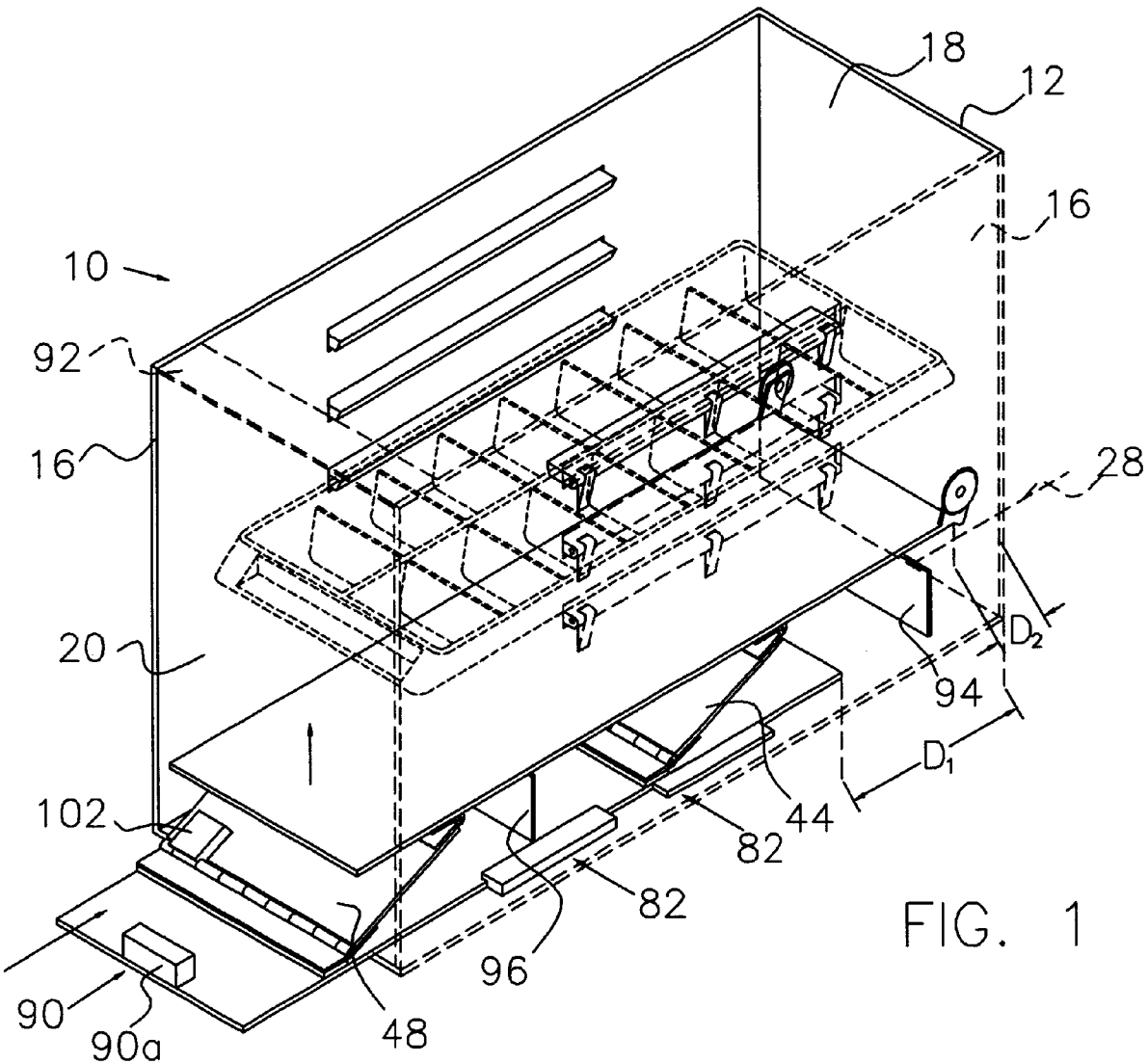
FIG. 1 is a perspective view of one embodiment of the invention depicting a single ice cube tray stored in the storage bin.

Referring now to the drawings, in particular FIG. 1, the invention which is an elevator ice tray storage apparatus and is depicted generally as 10, includes an ice tray storage bin 12 having a bottom 14, opposite spaced-apart side walls 16, a back end wall 18 and an open front end 20; and means 22 for elevating ice trays 62 to a first elevated storage position 24, said first elevated storage position 24 having means 26 for level supporting of ice tray side edges 70 along the side walls 16 of the storage bin 12, wherein when said means 22 for elevating ice trays 62 is lowered to its lowest position 28, a height 30 between said means 22 for elevating ice trays 62 and a lower surface 32 of a first ice tray 34 being supported at the first elevated storage position 24 is sufficient to enable a second ice tray 36 to be placed on said means 22 for elevating ice trays 62.

Figure 2:
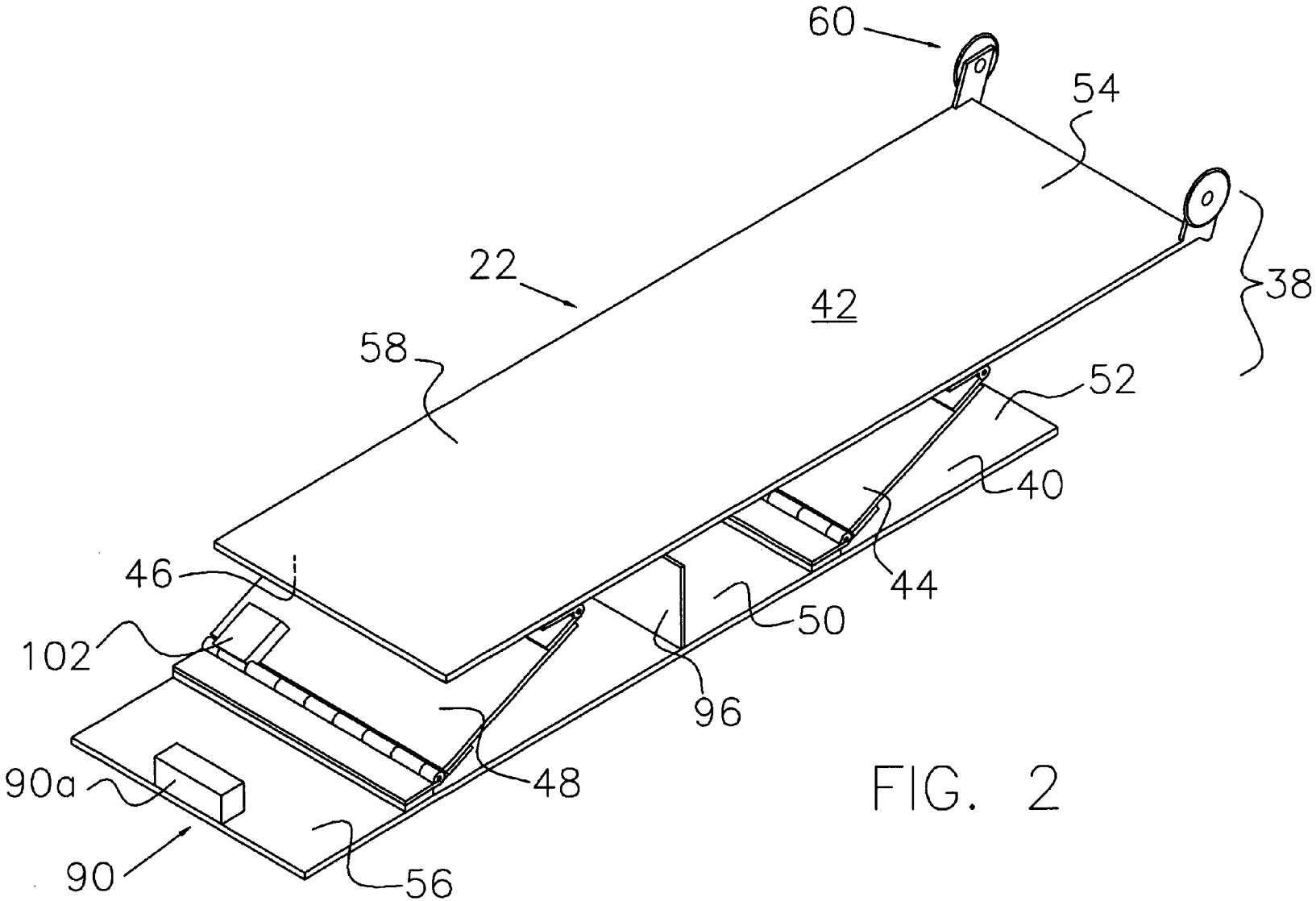
FIG. 2 is a perspective view of one embodiment of the elevator platform assembly portion of the invention.

As shown in FIG. 2, the means 22 for elevating ice trays 62 includes an elevator platform assembly 38 in an overlying relationship to the bottom 14 of the storage bin 12. The elevator platform assembly 38 includes a base member 40 which is in a slidable relationship with the underlying bottom 14 of the storage bin 12, and a platform 42 parallel to and above the base member 40, the platform 42 constituting a platform for supporting and elevating an ice tray 62 to be stored in the storage bin 12 at the first elevated storage position 24.

A first riser member 44 is pivotally connected to an upper surface 50 of the base member 40 near a back end 52 of said base member 40. This first riser member 44 is also pivotally connected to a lower surface 46 of the platform 42 at a predetermined distance from a back end 54 of said platform 42. A second riser member 48 is pivotally connected to the upper surface 50 of the base member 40 at a predetermined distance from a front end 56 of said base member 40. As with the first riser member 44, this second riser member 48 is also pivotally connected to the lower surface 46 of the platform 42 at a predetermined distance from a front end 58 of said platform 42. The first and second riser members 44,48 are the same height and pivotally connected so as to maintain a parallel relationship as the elevator platform assembly 38 is manipulated.

The back end 54 of said platform 42 further has roller means 60 which engage the back end wall 18 of the storage bin 12 and roll up and down the back end wall 18 of the storage bin 12 as the elevator platform assembly 38 is manipulated to store ice trays 62 in the storage bin 12. The back end 54 of the platform 42 and the back end 52 of the base member 40 are offset from each other such that the back end 52 of the base member 40 is spaced from the back end wall 18 of the storage bin 12 a distance $D_1$ greater than a distance $D_2$ of the back end 54 of the platform 42 from the back end wall 18 of the storage bin 12, that is, $D_1>D_2$.

In other embodiments of the invention where more than two trays 62 are intended to be stored, that is, one at the first elevated storage position 24 and one on the platform 42, the invention includes a second elevated storage position 64 above the first elevated storage position 24 or a second and third elevated storage position 64,66, the third elevated storage position 66 being above the second elevated storage position 64. The second elevated storage position 64 has means 26 for level supporting of ice tray side edges 70 along the side walls 16 of the storage bin 12 and the third elevated storage position 66 also has means 26 for level supporting of ice tray side edges 70 along the side walls 16 of the storage bin 12.

Referring to FIGS. 4*a*–4*e*, in operation, when a second ice tray 36 is elevated for placement at the first elevated storage position 24, the second ice tray 36 comes into contact with the first ice tray 34. The means 22 for elevating ice trays 62 then elevates both the first and second ice trays 34,36 until the first ice tray 34 is positionable at the second elevated storage position 64. The means 22 for elevating ice trays 62 is then lowered so that the first ice tray 34 comes to rest on the means 26 for level supporting of ice tray side edges 70 at the second elevated storage position 64. When the third elevated storage position 66 is incorporated into the apparatus 10, the third ice tray 76 is elevated for placement at the first elevated storage position 24, the third ice tray 76 comes into contact with the second ice tray 36, and the second ice tray 36 then comes into contact with the first ice tray 34 as the means 22 for elevating ice trays 62 continues to elevate, the means 22 for elevating ice trays 62 then elevates the first, second and third ice trays 34,36,76 until the first ice tray 34 is positionable at the third elevated storage position 66, the means 22 for elevating ice trays 62 is then lowered so that the first ice tray 34 comes to rest on the means 26 for level supporting of ice tray side edges 70 at the third elevated storage position 66, the means 22 for elevating ice trays then continues to be lowered until the second ice tray 36 comes to rest on the means 26 for level supporting of ice tray side edges 70 at the second elevated storage position 64, the means 22 for elevating ice trays 62 then continues to be lowered so that the third ice tray 76 comes to rest on the means 26 for level supporting of ice tray side edges 70 at the first elevated storage position 24.

It is preferred that the bottom 14 of the storage bin 12 includes means 82 for guiding the travel of the base member 40 in and out of the storage bin 12 from the front end 20 of the storage bin 12.

Figure 3A:
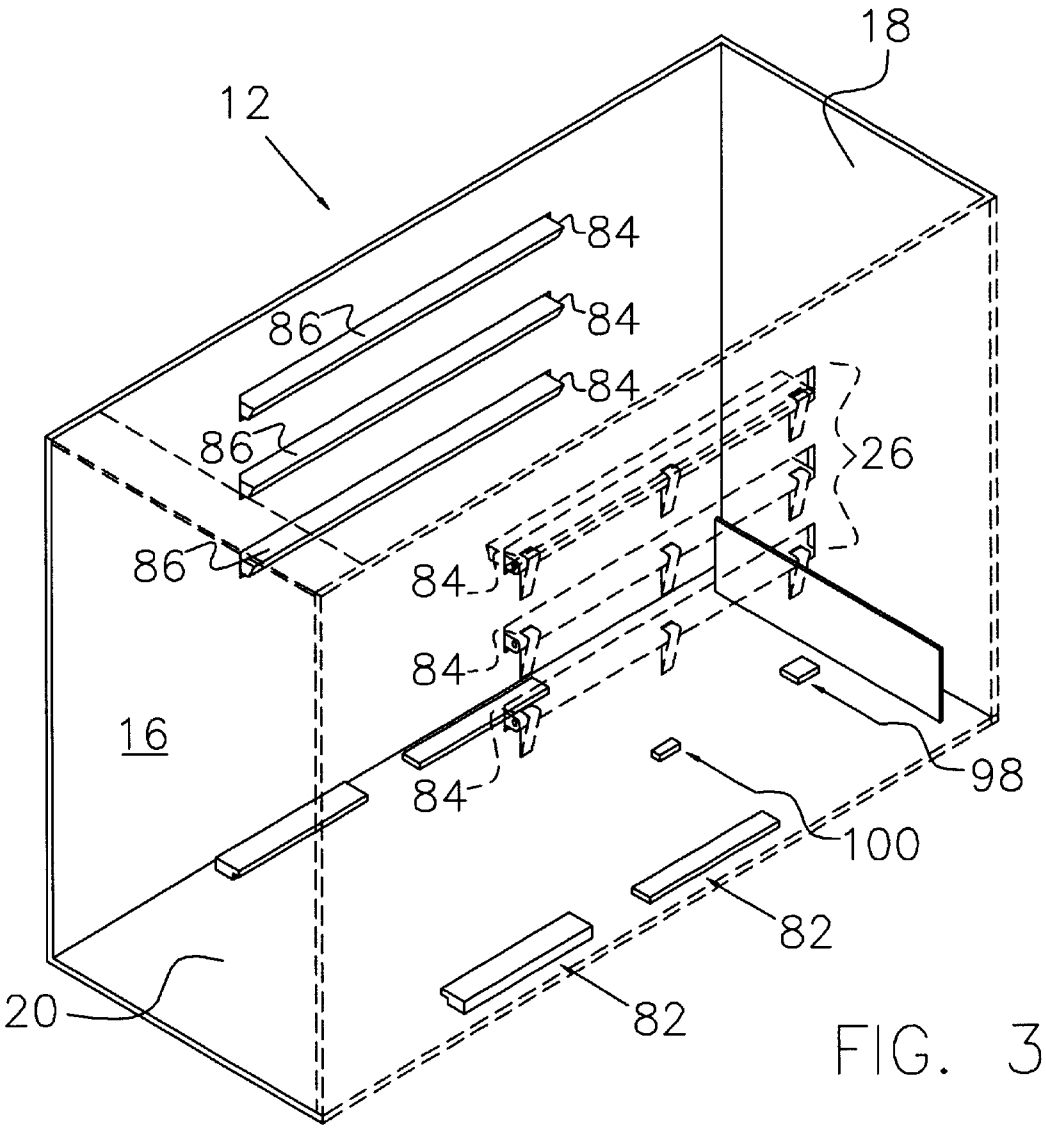
FIG. 3*a* is a perspective view of the storage bin depicting one embodiment of the incorporation of the means for level supporting of the ice tray side edges where one longitudinally hinged ice tray support is incorporated at each storage level in the storage bin side walls.
Figure 3B:
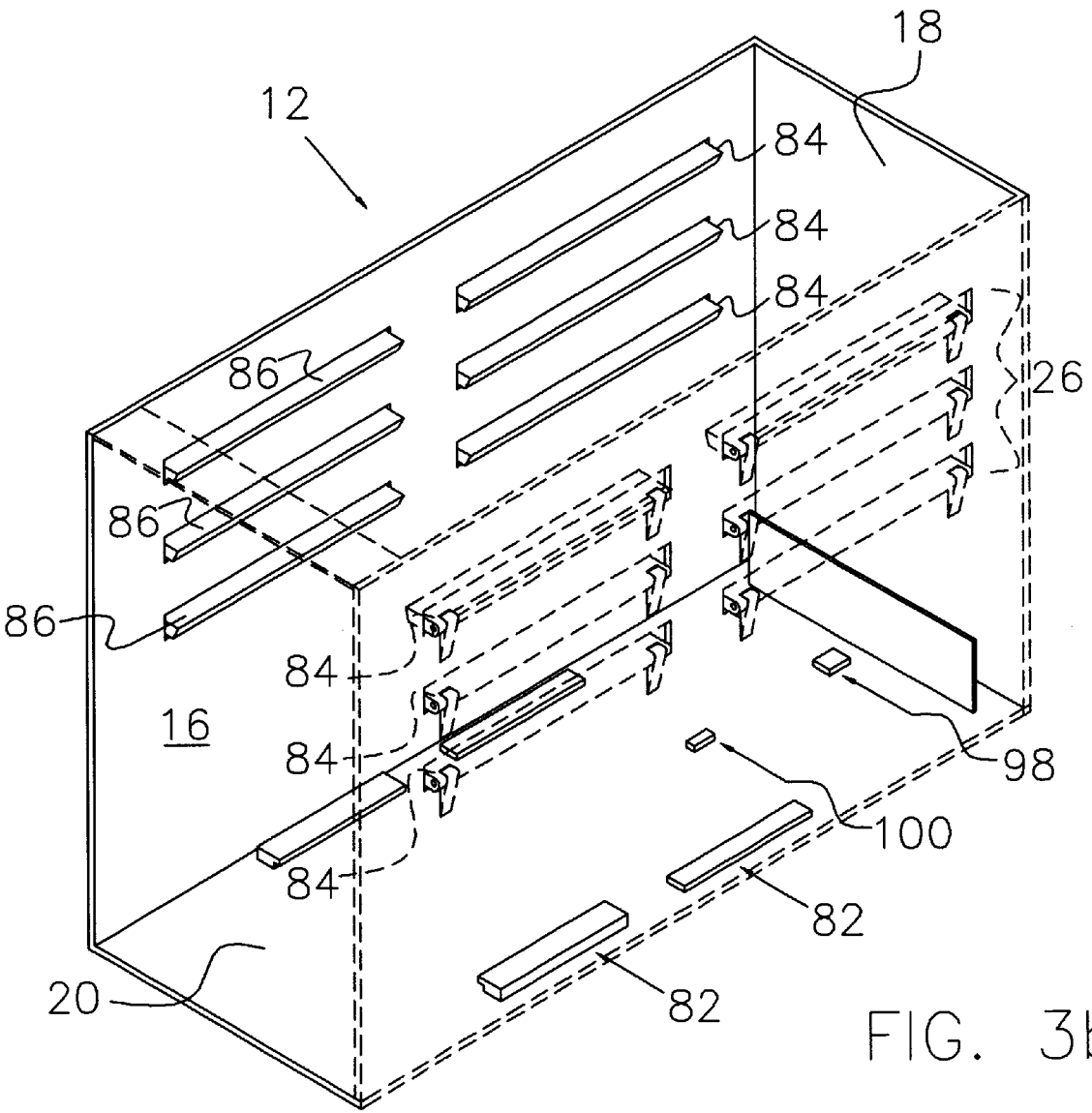
FIG. 3*b* is a perspective view of the storage bin depicting another embodiment of the incorporation of the means for level supporting of the ice tray side edges where two longitudinally hinged ice tray supports are incorporated at each storage level in the storage bin side walls.
Figure 3C:
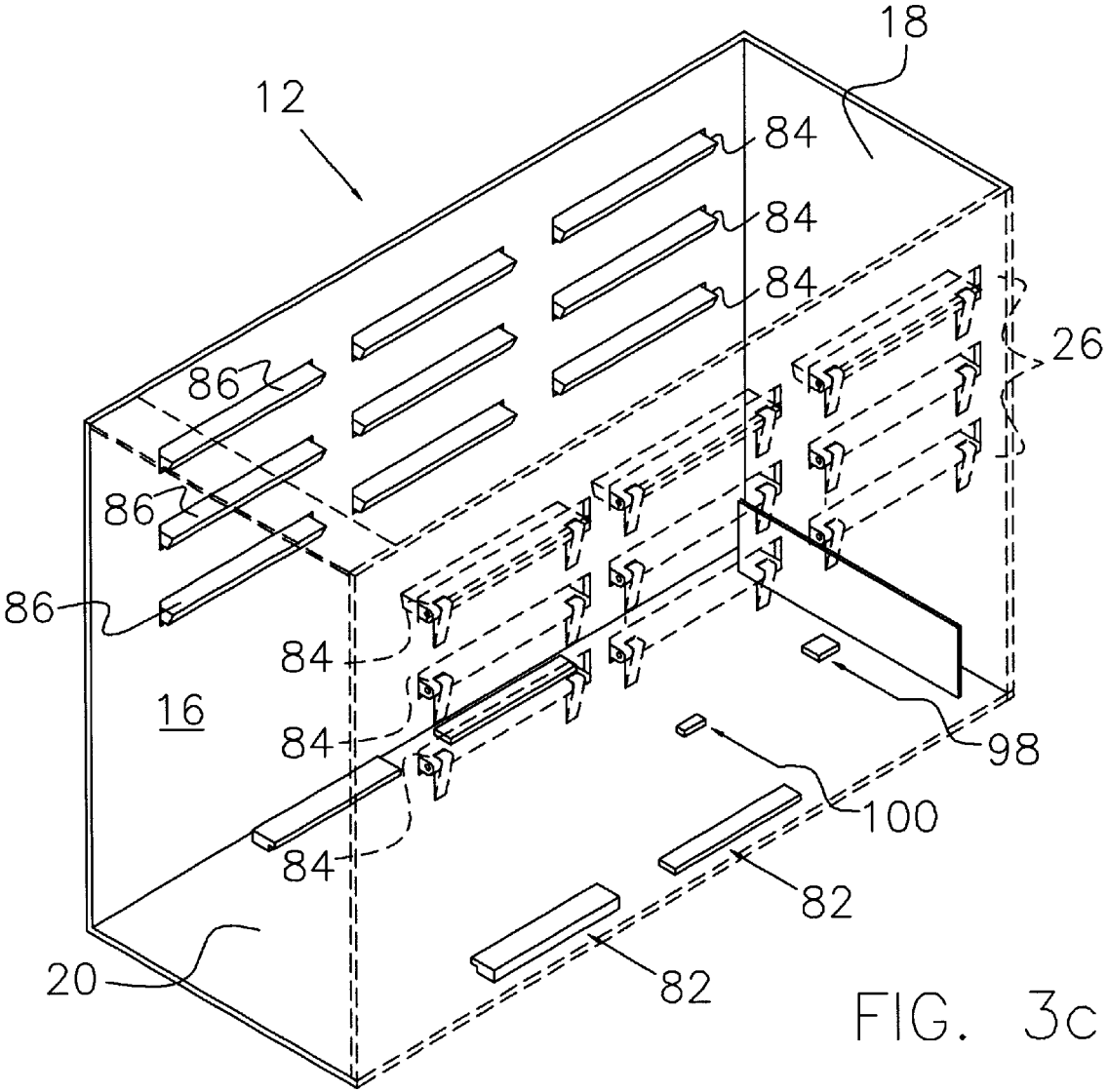
FIG. 3*c* is a perspective view of the storage bin depicting another embodiment of the incorporation of the means for level supporting of the ice tray side edges where three longitudinally hinged ice tray supports are incorporated at each storage level in the storage bin side walls.
Figure 4B:
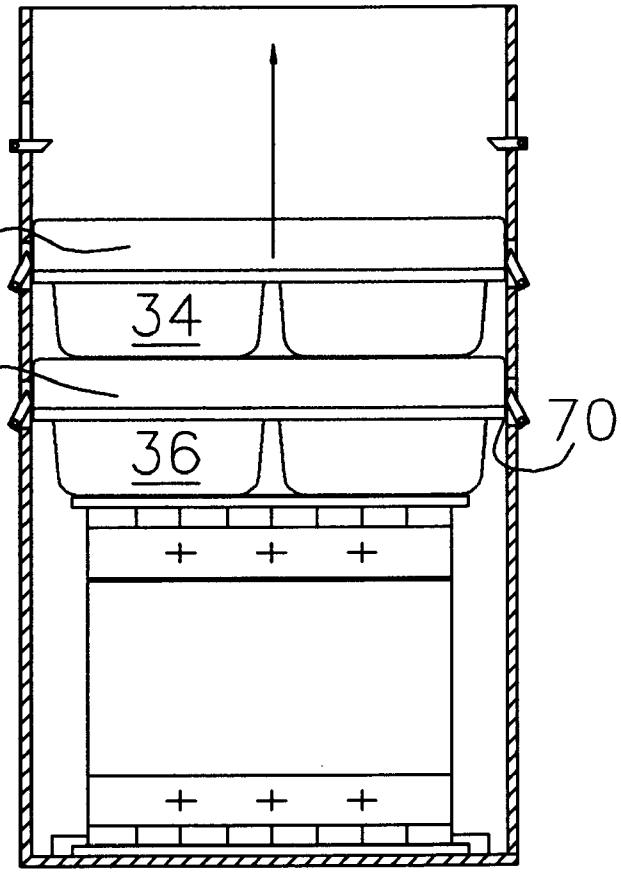
FIG. 4*b* is an elevation front view of the invention where a two trays are in the process of being elevated for storage in the storage bin.
Figure 4A:
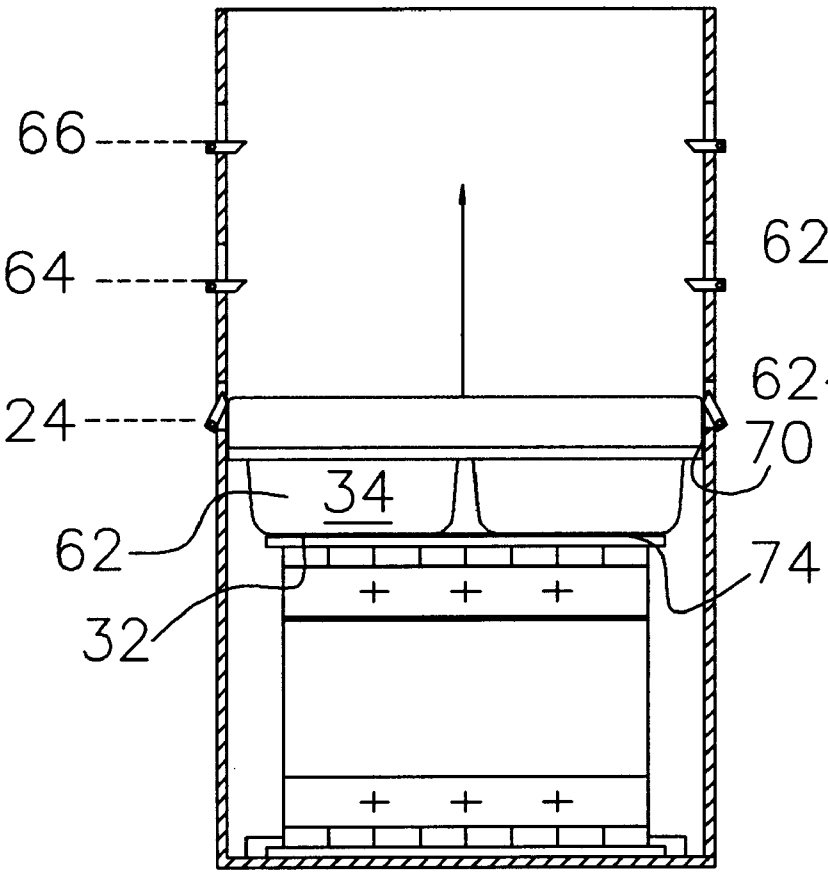
FIG. 4*a* is an elevation front view of the invention where, a single first tray is in the process of being elevated for storage in the storage bin.
Figure 4E:
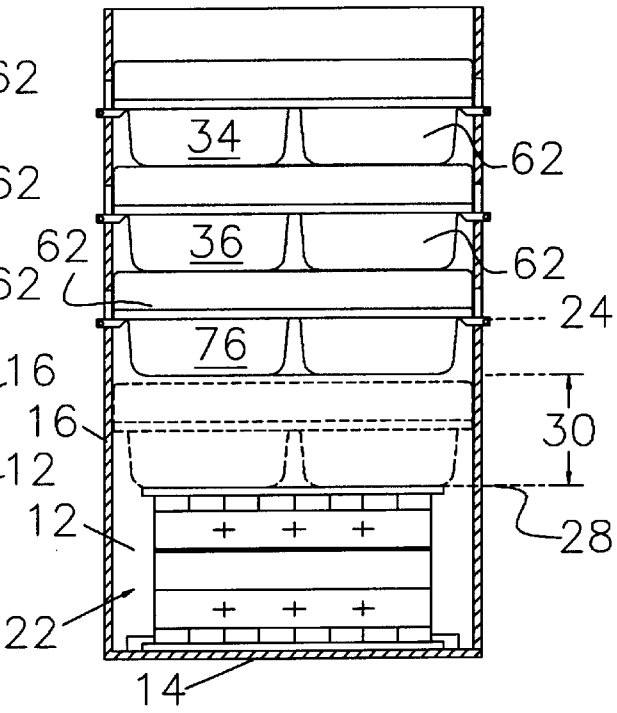
FIG. 4*e* is an elevation front view of the invention where three trays have been lowered to their respective storage positions in the storage bin.
Figure 4D:
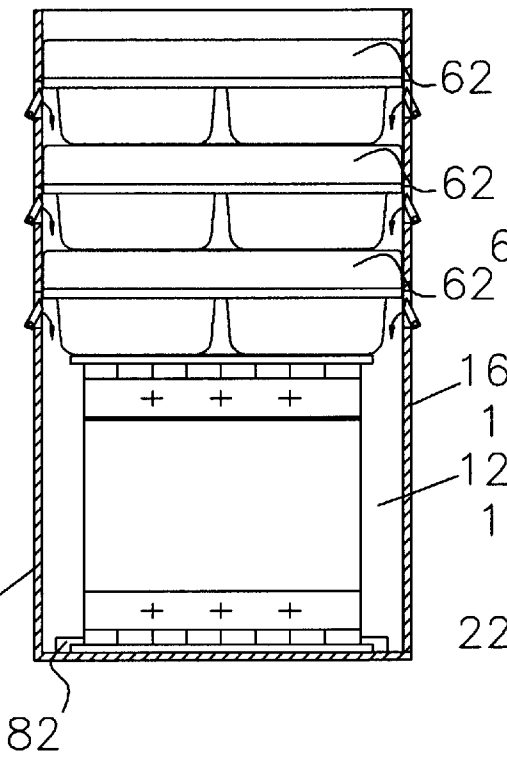
FIG. 4*d* is an elevation front view of the invention where a three trays are in the process of initiating the lowering of the trays for storage in the storage bin.
Figure 4C:
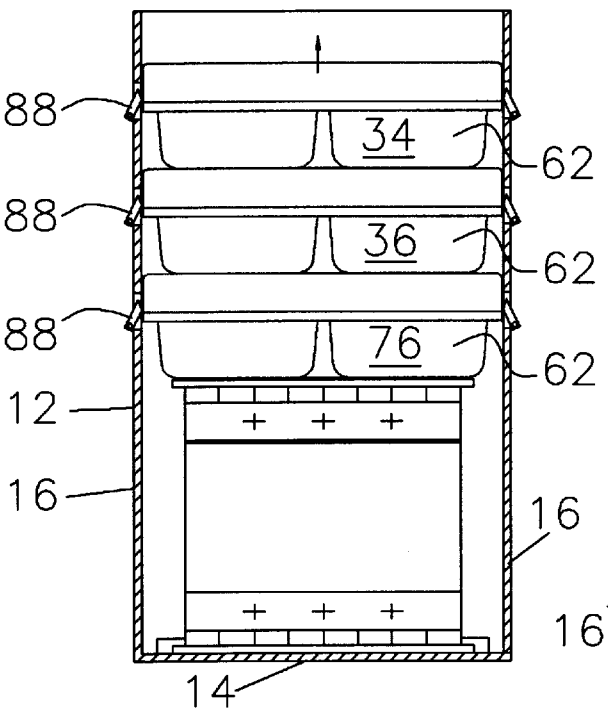
FIG. 4*c* is an elevation front view of the invention where a three trays are in the process of being elevated for storage in the storage bin.

As shown in FIGS. 3*a*–3*c*, the means 26 for level supporting of ice tray side edges 70 along the side walls 16 of the storage bin 12 at the first, second or third elevated storage positions 24,64,66 preferably includes at least one longitudinally hinged ice tray support 84 on each side wall 16, each being parallel to and of substantially equal distance from the bottom 14 of the storage bin 12, with each at least one longitudinally hinged ice tray support 84 constituting a flap which is rotatable from a generally horizontal planar position of repose 86 to a generally vertical position 88 when side edges 70 of the ice tray 62 to be stored engages corresponding opposite flaps while being elevated to the first elevated storage position 24, and the corresponding opposite flaps returning to the repose position 86 after each tray 62 is elevated past a rotated height of the flaps. When the ice tray 62 to be stored is then lowered, its corresponding side edges 70 engage and rest on the corresponding opposite flaps.

As shown in FIGS. 3*a*–3*c*, there are alternative methods of incorporating the at least one longitudinally hinged ice tray support 84 in the side walls 16 of the storage bin 12. One method may be to simply have one longitudinally hinged ice tray support 84 across a sufficient length of each side wall 16 such that the side edges 70 of an ice tray 62 is stable when resting on the longitudinally hinged ice tray support 84 in its position of repose 86. Another method may include the incorporation of two or three spaced apart longitudinally hinged ice tray supports 84 in a row at each of the elevated storage positions 24,64,66, again, the total length, including the spacing between each support 84 in a row being a sufficient length of each side wall 16 such that the side edges 70 of an ice tray 62 is stable when resting on the longitudinally hinged ice tray supports 84 in a row when in their position of repose 86.

When the ice tray 62 is placed on the platform 42 for elevated storage, the base member 40 is pushed toward the back end 18 of the bin 12, simultaneously allowing the roller means 60 at the back end 54 of the platform 42 to vertically roll against the back end wall 18 of the storage bin 12 and in turn rotating the riser members 44,48 toward a vertical orientation until the platform 42 elevates the ice tray 62 a sufficient height so its side edges 70 engage and upwardly push the first row of the corresponding opposite flaps, passing said corresponding opposite flaps at the first elevated storage position 24 to allow them to return to the position of repose 86, and when the base member 40 is then pulled back to lower the platform 42, the ice tray 62 lowers and its side edges 70 engage the corresponding flaps in the position of repose 86, allowing the platform 42 to be lowered a sufficient spacing from a bottom 74 of the ice tray 62 stored in the first elevated storage position 24 to further allow the subsequent placement of the second ice tray 36 on the platform 42.

The means 82 for guiding the travel of the base member 40 preferably includes means for minimizing one of lateral movement, vertical movement and a combination of lateral and vertical movement of the base member 40 as it slides in and out of the storage bin 12. In addition, the base member 40 should include means 90 for facilitating the sliding of the base member 40 in and out of the front end 20 of the storage bin 12 while inserting an ice tray 62, such as handle means 90*a* on a portion of the base member 40 adjacent the front end 20 of the storage bin 12. Handle means 90*a* may be provided in a number of ways, such as an aperture in the base member 40 through which a person may grasp with a finger, a built-up ridge or vertical extended portion, or a slightly indented area on which a person would again place finger to pull base member 40 out. The preferred method would incorporate a built-up ridge area near the front end 56 of the base member 40.

In order to maintain some rigidity or at least to prevent the upper portion of the storage bin 12 from spreading open which could make an ice tray 62 dislodge from the supporting flaps, it is recommended that means 92 at the top of the storage bin 12 for maintaining the side walls 16 in a generally parallel relationship be provided. This can simply be some bracing or strapping like members across designated portions at the top of the storage bin 12, in particular, at least across the front edge or near the front edge of the storage bin 12.

The storage bin bottom 14, side walls 16 and back end wall 18 may be continuously formed such as in an injection molding process therein making the joints integral, or they may be fixedly connected such as by adhesive or other mechanical methods like fasteners, or a combination of such construction methods may be incorporated.

It is not necessary that the platform 42 be allowed to be lowered such that the platform 42, riser members 44,48 and base member 40 essentially lay on top of the other; however, it is recommended that a first support member 94 vertically extending from the bottom 14 of the storage bin 12 near the back end 18 of the storage bin 12 for support engagement of the platform 42 in its lowered position be provided, and a second support member 96 vertically extending from an intermediate location on the base member 40 of the elevator platform assembly 38 for support engagement of the platform 42 in its lowered position be provided. The first and second support members 94,96 are dimensioned so as to maintain the platform in a generally parallel relationship to the bottom 14 of the storage bin 12, yet spaced apart a desired predetermined distance.

If the riser members 44,48 rotate 90° or greater, it is possible that when the base member 40 is pulled to start lowering the trays 62, that all the trays 62 will instead come out of the storage bin 12 at once and the platform 42 will not lower unless the riser members 44,48 are caused to be nudged to less than a 90° orientation. If this is undesirable, then it is recommended that means 98 for limiting the inward travel of the base member 40 be provided so that the first and second riser members 44,48 are prevented from elevating into this generally vertical orientation. Another method of providing means for preventing the riser members 44,48 from rotating greater or equal to this 90° orientation is to provide a rotation stopper 102, as shown in FIGS. 1 and 2, on the hinged riser member(s) 44,48 such that as the riser members 44,48 rotate, stopper 102 comes into contact with base member 40 thereby limiting the degree of rotation of the riser members 44,48.

Although it may be preferred that the elevator platform assembly 38 be readily removable from the storage bin 12 to provide ready access for cleaning the storage bin 12, means 100 for limiting the outward travel of the base member 40 to prevent the elevator platform assembly 38 from completely exiting the storage bin 12, may optionally be provided.

Although the materials typically used to make the storage bin 12 and the elevator platform assembly 38 may vary such as by using food grade stainless steel, it is recommended that polymeric plastic materials be used. In addition, any hinged or pivoting part may be made by any method known in the art, based on the desired design preferences of the manufacturer.

As seen from the foregoing description, the present invention satisfies a long felt need to provide a device for stacking ice trays in a freezer while eliminating or minimizing the chances of spilling water from ice trays while allowing irregular shaped objects like frozen food bags to be stored in a freezer without knocking over the ice trays.

The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described.

What is claimed is:

1. An elevator ice tray storage apparatus comprising:

an ice tray storage bin having a bottom, opposite spaced-apart side walls, a back end wall and an open front end; and means for elevating ice trays to a first elevated storage position, said first elevated storage position having means for level supporting of ice tray side edges along the side walls of the storage bin, wherein when said means for elevating ice trays is lowered to its lowest position, a height between said means for elevating ice trays and a lower surface of a first ice tray being supported at the first elevated storage position is sufficient to enable a second ice tray to be placed on said means for elevating ice trays.

2. The elevator ice tray storage apparatus according to claim 1, wherein the means for elevating ice trays comprises:

an elevator platform assembly in an overlying relationship to the bottom of the storage bin;

the elevator platform assembly including a base member being in a slidable relationship with the underlying bottom of the storage bin, and a platform parallel to and above the base member, the platform constituting a platform for supporting and elevating an ice tray to be stored in the storage bin at the first elevated storage position;

a first riser member being pivotally connected to an upper surface of the base member near a back end of said base member, the first riser member further being pivotally connected to a lower surface of the platform at a predetermined distance from a back end of said platform;

a second riser member being pivotally connected to the upper surface of the base member at a predetermined distance from a front end of said base member, the second riser member further being pivotally connected to the lower surface of the platform at a predetermined distance from a front end of said platform;

the first and second riser members being the same height and pivotally connected so as to maintain a parallel relationship as the elevator platform assembly is manipulated;

the back end of said platform further having roller means, the roller means for engaging the back end wall of the storage bin and for rolling up and down said back end wall of the storage bin as the elevator platform assembly is manipulated to store ice trays in the storage bin; and the back end of the platform and the back end of the base member being offset from each other such that the back end of the base member is spaced from the back end wall of the storage bin a distance greater than a distance of the back end of the platform from said back end wall of the storage bin.

3. The elevator ice tray storage apparatus according to claim 2, further comprising:

one of a second elevated storage position above said first elevated storage position and a second and third elevated storage position, the third elevated storage position being above said second elevated storage position; and said second elevated storage position having means for level supporting of ice tray side edges along the side walls of the storage bin and said third elevated storage position also having means for level supporting of ice tray side edges along the side walls of the storage bin, wherein when a second ice tray is elevated for placement at the first elevated storage position, the second ice tray comes into contact with the first ice tray, the means for elevating ice trays then elevating both the first and second ice trays until the first ice tray is positionable at the second elevated storage position, the means for elevating ice trays then being lowered so that the first ice tray comes to rest on the means for level supporting of ice tray side edges at the second elevated storage position, and wherein when the third elevated storage position is incorporated into the apparatus, and a third ice tray is elevated for placement at the first elevated storage position, the third ice tray comes into contact with the second ice tray, the second ice tray then coming into contact with the first ice tray as the means for elevating ice trays continues to elevate, the means for elevating ice trays then elevating the first, second and third ice trays until the first ice tray is positionable at the third elevated storage position, the means for elevating ice trays then being lowered so that the first ice tray comes to rest on the means for level supporting of ice tray side edges at the third elevated storage position, the means for elevating ice trays then continuing to be lowered until the second ice tray comes to rest on the means for level supporting of ice tray side edges at the second elevated storage position, the means for elevating ice trays then continuing to be lowered so that the third ice tray comes to rest on the means for level supporting of ice tray side edges at the first elevated storage position.

4. The elevator ice tray storage apparatus according to claim 2, wherein the bottom of the storage bin includes means for guiding the travel of the base member in and out of the storage bin from the front end of the storage bin.

5. The elevator ice tray storage apparatus according to claim 2, wherein the means for level supporting of ice tray side edges along the side walls of the storage bin at the first elevated storage position comprises:

at least one longitudinally hinged ice tray support on each side wall, each being parallel to and of substantially equal distance from the bottom of the storage bin;

each at least one longitudinally hinged ice tray support constituting a flap which is rotatable from a generally horizontal planar position of repose to a generally vertical position when side edges of the ice tray to be stored engage corresponding opposite flaps while being elevated to the first elevated storage position; and said corresponding opposite flaps returning to the repose position after each tray is elevated past a rotated height of the flaps, wherein the ice tray to be stored is then lowered and its corresponding side edges engage and rest on the corresponding opposite flaps, and wherein when the ice tray is placed on the platform, the base member is pushed toward the back end of the bin, simultaneously allowing the roller means at the back end of the platform to vertically roll against the end wall of the storage bin and in turn rotating the riser members toward a vertical orientation until the platform elevates the ice tray a sufficient height so its side edges engage and upwardly push the first row of the corresponding opposite flaps, passing said corresponding opposite flaps at the first elevated storage position to allow them to return to the position of repose, and when the base member is then pulled back to lower the platform, the ice tray lowers and its side edges engage the corresponding flaps in the position of repose, allowing the platform to be lowered a sufficient spacing from a bottom of the ice tray stored in the first elevated storage position to further allow the subsequent placement of the second ice tray on the platform.

6. The elevator ice tray storage apparatus according to claim 4, wherein the means for guiding the travel of the base member further comprises:

means for minimizing one of lateral movement, vertical movement and a combination of lateral and vertical movement of the base member as it slides in and out of the storage bin.

7. The elevator ice tray storage apparatus according to claim 2, wherein the base member further comprises:

means for facilitating the sliding of the base member in and out of the front end of the storage bin while inserting an ice tray.

8. The elevator ice tray storage apparatus according to claim 7, wherein the means for facilitating the sliding of the base member in and out of the front end of the storage bin includes handle means on a portion of the base member adjacent the front end of the storage bin.

9. The elevator ice tray storage apparatus according to claim 1, wherein the storage bin further comprises:

means at the top of the storage bin for maintaining the side walls in a generally parallel relationship.

10. The elevator ice tray storage apparatus according to claim 1, wherein a joinder of the bottom, side walls and back end wall of the storage bin are one of integrally formed, fixedly connected and a combination thereof.

11. The elevator ice tray storage apparatus according to claim 2, further comprising:

a first support member vertically extending from the bottom of the storage bin near the back end of the storage bin for support engagement of the platform in its lowered position; and a second support member vertically extending from an intermediate location on the base member of the elevator platform assembly for support engagement of the platform in its lowered position, wherein the first and second support members maintain the platform in generally parallel to the bottom of the storage bin.

12. The elevator ice tray storage apparatus according to claim 2, further comprising:

means for limiting the inward travel of the base member so that the first and second riser members are prevented from elevating into a generally vertical orientation.

13. The elevator ice tray storage apparatus according to claim 2, further comprising:

means for limiting the outward travel of the base member to prevent the elevator platform assembly from completely exiting the storage bin.

14. An elevator ice tray storage apparatus comprising:

an ice tray storage bin, having a bottom, spaced-apart side walls, a back end wall and an open front end;

an elevator platform assembly in an overlying relationship to the bottom of the storage bin;

the elevator platform assembly including a base member being in a slidable relationship with the underlying bottom of the storage bin, and a platform parallel to and above the base member, the platform constituting a platform for supporting and elevating an ice tray into a first elevated storage position;

a first riser member being pivotally connected to an upper surface of the base member near a back end of said base member, the first riser member further being pivotally connected to a lower surface of the platform at a predetermined distance from a back end of said platform;

a second riser member being pivotally connected to an upper surface of the base member at a predetermined distance from a front end of said base member, the second riser member further being pivotally connected to a lower surface of the platform at a predetermined distance from a front end of said platform;

the first and second riser members being the same height and pivotally connected so as to maintain a parallel relationship as the elevator platform assembly is manipulated;

the back end of said platform further having roller means, the roller means for engaging the back end wall of the storage bin and for rolling up and down said back end wall of the storage bin as the elevator platform assembly is manipulated to store ice trays in the storage bin;

the back end of the platform and the back end of the base member being offset from each other such that the back end of the base member is spaced from the back end wall of the storage bin a distance greater than a distance of the back end of the platform from said back end wall of the storage bin;

the bottom of the storage bin having means for guiding the travel of the base member in and out of the storage bin from the front end of the storage bin;

each side wall having at least one row of at least one longitudinally hinged ice tray support, each row of the at least one longitudinally hinged ice tray support on one side wall being parallel to and of substantially equal distance from the bottom of the storage bin as a corresponding row in the opposite side wall;

each at least one longitudinally hinted ice tray support constituting a flap and said corresponding row of opposite flaps being rotatable from a generally horizontal planar position of repose to a generally vertical position when side edges of the ice tray to be stored engage said opposite flaps in one of the at least one row while being elevated to one of the first elevated storage position when only one ice tray is to be stored, and the first and a subsequent elevated storage position when more than one ice tray is to be simultaneously elevated to a respective elevated storage position;

said opposite flaps returning to the repose position after each tray is elevated past a rotated height of the flaps, wherein each ice tray to be stored is then lowered and its corresponding side edges engage and rest on the opposite flaps, wherein when the ice tray is placed on the platform; the base member is pushed toward the back end of the bin, simultaneously allowing the roller means at the back end of the platform to vertically roll against the end wall of the storage bin and in turn rotating the riser members toward a vertical orientation until the platform elevates the ice tray a sufficient height so its side edges engage and upwardly push the first row of the corresponding opposite flaps, passing said corresponding opposite flaps to allow them to return to the position of repose, and when the base member is then pulled back to lower the platform, the ice tray lowers and its side edges engage the opposite flaps in the position of repose, allowing the platform to be lowered a sufficient spacing from a bottom of the ice tray stored in the first elevated storage position to further allow the subsequent placement of another ice tray on the platform.

15. The elevator ice tray storage apparatus according to claim 14, wherein the means for guiding the travel of the base member further comprises:

means for minimizing one of lateral movement, vertical movement and a combination of lateral and vertical movement of the base member as it slides in and out of the storage bin.

16. The elevator ice tray storage apparatus according to claim 14, wherein the base member further comprises:

means for facilitating the sliding of the base member in and out of the front end of the storage bin while inserting an ice tray.

17. The elevator ice tray storage apparatus according to claim 16, wherein the means for facilitating the sliding of the base member in and out of the front end of the storage bin comprises:

handle means on a portion of the base member adjacent the front end of the storage bin.

18. The elevator ice tray storage apparatus according to claim 14, wherein the storage bin further comprises:

means at the top of the storage bin for maintaining the side walls in a generally parallel relationship.

19. The elevator ice tray storage apparatus according to claim 14, wherein a joinder of the bottom, side walls and back end wall of the storage bin are one of integrally formed, fixedly connected and a combination thereof.

20. The elevator ice tray storage apparatus according to claim 14, further comprising:

a first support member vertically extending from the bottom of the storage bin near the back end of the storage bin for support engagement of the platform in its lowered position; and a second support member vertically extending from an intermediate location on the base member of the elevator platform assembly for support engagement of the platform in its lowered position, wherein the first and second support members maintain the platform in generally parallel to the bottom of the storage bin.

21. The elevator ice tray storage apparatus according to claim 14, further comprising:

means for limiting the inward travel of the base member so that the first and second riser members are prevented from elevating into a generally vertical orientation.

22. The elevator ice tray storage apparatus according to claim 14, further comprising:

means for limiting the outward travel of the base member to prevent the elevator platform assembly from completely exiting the storage bin.

* * * * *